US008091159B2

(12) United States Patent
Harris

(10) Patent No.: US 8,091,159 B2
(45) Date of Patent: Jan. 10, 2012

(54) MECHANISM AND MATTRESS FOR SOFABED

(76) Inventor: Anne Harris, New York, NY (US)

( * ) Notice: Subject to any disclaimer, the term of this patent is extended or adjusted under 35 U.S.C. 154(b) by 3 days.

(21) Appl. No.: 12/655,924

(22) Filed: Jan. 11, 2010

(65) Prior Publication Data

US 2011/0167558 A1 Jul. 14, 2011

(51) Int. Cl.
*A47C 17/13* (2006.01)

(52) U.S. Cl. ..... 5/18.1; 5/12.1

(58) Field of Classification Search ..... 5/18.1, 5/17, 12.1, 41, 48, 722, 723, 727, 728
See application file for complete search history.

(56) References Cited

U.S. PATENT DOCUMENTS

| | | | | | |
|---|---|---|---|---|---|
| 1,061,533 | A | * | 5/1913 | Englander | 5/48 |
| 1,061,956 | A | * | 5/1913 | Englander | 5/48 |
| 1,354,540 | A | * | 10/1920 | Dixon | 5/42.1 |
| 1,413,595 | A | * | 4/1922 | Kreuzkamp | 5/18.1 |
| 2,143,355 | A | * | 1/1939 | Martin | 5/18.1 |
| 2,568,366 | A | * | 9/1951 | Rosen | 5/18.1 |
| 2,628,368 | A | * | 2/1953 | Gordon et al. | 5/48 |
| 3,060,460 | A | * | 10/1962 | Broyles | 5/18.1 |
| 3,357,030 | A | * | 12/1967 | George | 5/41 |
| 3,385,631 | A | * | 5/1968 | Gertler | 297/111 |
| 3,555,581 | A | * | 1/1971 | Friant | 5/705 |
| 3,740,774 | A | * | 6/1973 | Powell | 5/12.1 |
| 4,086,671 | A | * | 5/1978 | Lane | 5/18.1 |
| 4,204,287 | A | * | 5/1980 | Lane et al. | 5/18.1 |
| 4,343,054 | A | | 8/1982 | Kane | |
| 4,402,096 | A | * | 9/1983 | Atimichuk | 5/17 |
| 4,481,684 | A | * | 11/1984 | Hauck | 5/18.1 |
| 4,586,206 | A | | 5/1986 | Singer | |
| 4,694,514 | A | * | 9/1987 | Crossett | 5/12.1 |
| 4,953,242 | A | | 9/1990 | Harris | |
| 5,038,421 | A | | 8/1991 | Harris | |
| 5,231,710 | A | | 8/1993 | Markel et al. | |
| 5,920,928 | A | | 7/1999 | Piretti | |
| 7,240,381 | B1 | * | 7/2007 | Hawse | 5/18.1 |
| 2003/0167566 | A1 | | 9/2003 | Inagaki | |
| 2011/0167558 | A1 | * | 7/2011 | Harris | 5/18.1 |

* cited by examiner

*Primary Examiner* — Robert G Santos
(74) *Attorney, Agent, or Firm* — Leason Ellis LLP.

(57) ABSTRACT

A convertible sofabed is a sofa when closed in a sitting position and a bed when opened in a sleeping position. A retractable support structure can be telescoped from the sofa to form, in conjunction with the sofa, a bed that is longer than the depth of the sofa in its sitting position. The mattress in the sleeping position is folded in three portions, a fixed portion, a central portion and an outer portion. The outer portion forms a sofaback in the sitting position and the central portion folds to lie on top of the fixed portion to form the seat of the sofabed. The support structure includes curved legs that travel easily over the floor without causing damage.

10 Claims, 5 Drawing Sheets

MECHANISM AND MATTRESS FOR SOFABED

CLAIM OF PRIORITY

This patent application claims the benefit of priority under 35 U.S.C. §119 of U.S. Provisional Patent Application Ser. No. 61/204,746, filed Jan. 9, 2009, entitled "Back Saver Sofa." The disclosure of this application is incorporated herein by reference in its entirety.

FIELD OF INVENTION

The present invention relates to sofabeds, and in particular to converting mechanisms and mattresses for sofas that allow them to be easily converted into beds, and which are light weight.

BACKGROUND OF THE INVENTION

The mechanisms used in making furniture that is intended to be converted between a sitting unit, e.g., a chair or sofa, in the closed position and a bed in the open position are usually very complicated. These mechanisms include springs, bars, and hinges which may damage sheeting or upholstery. The user may also catch his or her fingers in these mechanisms and receive physical injuries. Such conventional conversion mechanisms have been relatively difficult and complicated to use, especially for the elderly, children and the handicapped.

Furthermore, these mechanisms increase the weight of the furniture, making it more difficult both to move the furniture and to convert it. In addition, these mechanisms often require substantial volume, adding to the volume occupied by the furniture. This is usually apparent in an increase in the depth of the furniture, which is undesirable since space is often at a premium.

Prior attempts to overcome these problems are addressed in U.S. Pat. Nos. 4,953,242 and 5,038,421 of the present inventor. In these patents a sofabed is described in which a sliding support mechanism can be drawn out from the base of the sofa in order to create a bed. The mechanism in U.S. Pat. No. 4,953,242 has a single sliding support that essentially doubles the size of the seating area to form a bed. While this mechanism does reduce the difficulty in changing from a sofa to a bed and does reduce the weight, the bed area is not very large. Also, because of a storage area, when the mechanism is closed to form a sofa, there is a reduced seating area and this area needs to be moved when it is converted into a bed, thus complicating the mechanism. The arrangement in U.S. Pat. No. 5,038,421 uses a double sliding support and an unfolding triple mattress that forms the back of the sofa with one fold and doubles to form two folds that comprise the seat of the sofa. A pillow is folded to provide support at the intersection of the top section and the other two sections of the mattress in the closed or sitting configuration. When the sofabed is opened, the pillow is unfolded to function as a pillow for the bed and the double part of the mattress unfolds to provide a portion of the bed. With this arrangement the sofa has an uncomfortable straight vertical back.

It would be an improvement in these prior designs if the storage area were modified or removed to simply conversion. Also, it would be beneficial if some means were provided to allow the legs of the sliding support to travel over a wood floor or carpet without damaging the floor or becoming snagged on the carpet. Further, it would be beneficial if the backrest of the sofa could be at a more comfortable incline.

SUMMARY OF THE INVENTION

The present invention is directed to a mechanism and mattress to be used to form a convertible sofabed that can be easily changed from a sofa to a bed, is light in weight, extends over floors without difficulty and has a slanted backrest to allow for more comfortable seating in the sofa configuration.

In an exemplary embodiment of the invention a sofabed mechanism is installed in a sofa frame so the sofa is convertible between a sofa when the mechanism is in a closed position and a bed when in an open position. The sofabed is adapted to stand on a surface, such as a floor. It includes a conventional sofa frame with a first side, a second side, and a back or backrest connecting the first and second sides at substantially right angles to form a box-like structure. A conversation mechanism is secured in the bottom of the box-like structure. This mechanism includes a stationary structure and two telescoping sliding support structures. The structures form the base of the seat of a sofa when in the closed position. When the two sliding support structures are telescoped out of the stationary structure, those sliding support structures and the stationary structure provide the base for a bed. While the stationary structure does not move during conversion, the two support structures do move over the floor. Curved legs extend from the bottom of each of the sliding support structures. The curve of the legs allows them to pass over carpet without snagging and the smooth surface of the legs allows them to pass over hardwood floors without doing damage.

A three-part mattress is used with the design to form the bed located on the support structures after the sliding support structures have been telescoped out of the stationary structure into their extended position. An anchor plate may be located at the distal end of the outermost telescoping support structure to assist in holding the mattress in place. Further, the outermost part of the mattress and the center part are hinged together along their contiguous bottom edges. The center part and the innermost part of the mattress are hinged together along their contiguous top edges. The innermost part of the mattress does not move during a conversation and remains in the same position on the stationary support structure. As a result, it can be fastened to the stationary support structure. When converted from a bed to a sofa, the center part of the mattress is pivoted about its hinge point so that it lies on top of the innermost part. In this position the bottom of the center part of the mattress in the bed configuration becomes the top of the seat in the sofa configuration. The outermost part of the mattress is than pivoted around its hinge and comes to rest against a slanted back of the box-like sofa frame in order to form a comfortable backrest for the sofa. A piece of cushion material may be fixed on top of the innermost mattress part where it abuts the back of the box-like frame. This piece can support the outermost part of the mattress when it acts as a backrest and as a pillow when the sofabed is in the bed configuration.

The two telescoping support structures can be slid back into the stationary support structure to complete the transformation from a bed to a sofa. The telescoping structures may have a top surface made of metal mesh surrounded by metal channels connected to downwardly extending legs. As an alternative, the support structures can have a top surface made of slats or springs of metal or other material connected to channel material. The legs on the two support structures are horizontally displaced from each other so as not to collide when the outer support structure telescopes into the other one. These telescoping structures may be provided with ball bearings to ease the telescoping action. Further, the legs are sturdy, but smooth, and have a curved shape so that they can travel over carpet and hardwood floors without incident.

BRIEF DESCRIPTION OF THE DRAWINGS

The foregoing and other features of the present invention will be more readily apparent from the following detailed description and drawings of an illustrative embodiment of the invention in which.

DESCRIPTION OF AN ILLUSTRATIVE EMBODIMENT

Figure 1:
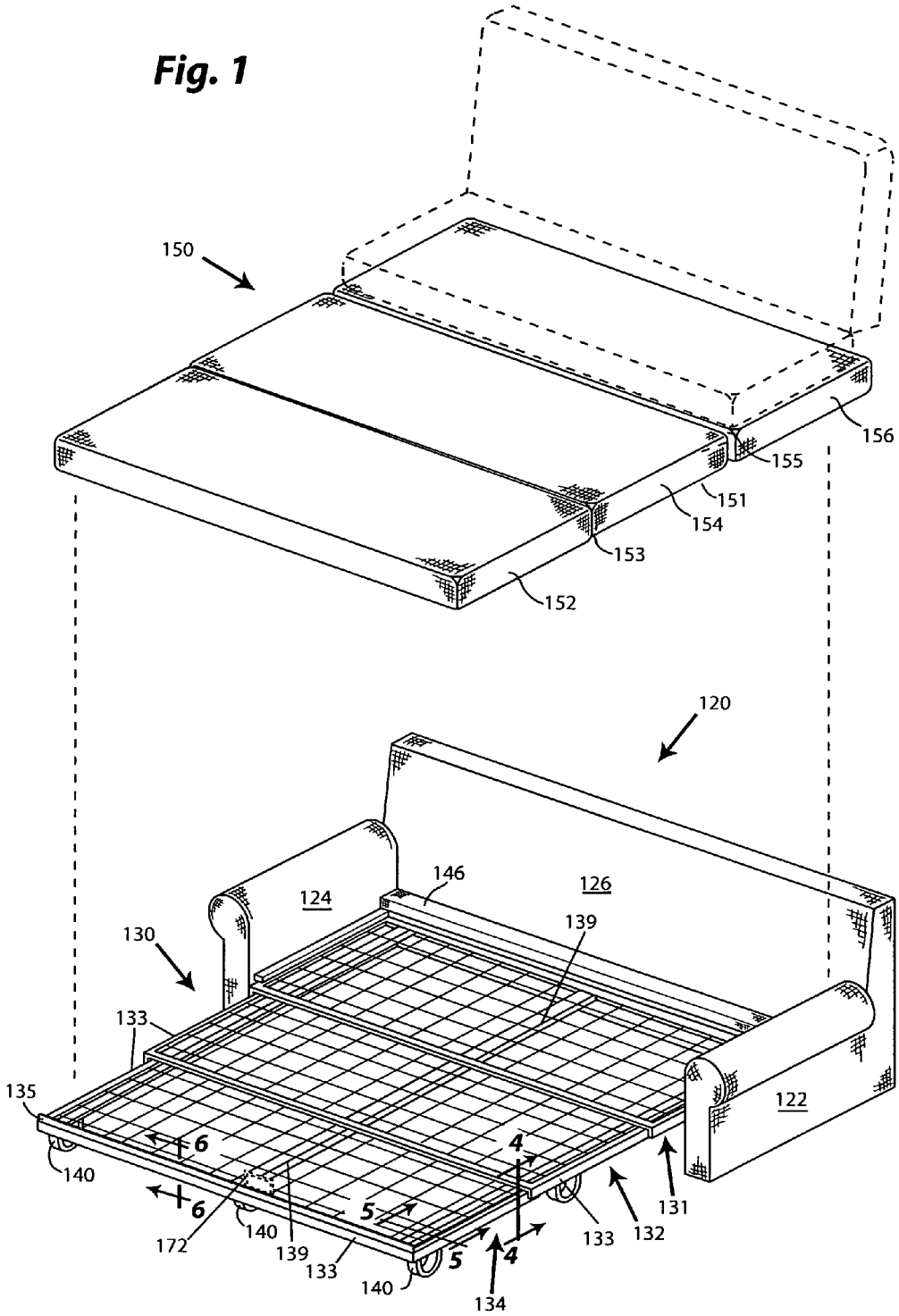
FIG. 1 is an exploded front, right, top perspective view of an embodiment of the sofabed mechanism and mattress of the present invention in the open position with relation to a sofa frame.

FIG. 1 is an exploded perspective view of a sofabed 120 according to the invention. The sofabed is adapted to stand on a surface, such as a floor. It includes a frame with a first side 122, a second side 124 and a sofaback 126 between and connecting the sides 122 and 124 into a box-like structure. The sofa frame is of any conventional design and the conversion mechanism and mattress are designed to be installed on such conventional sofa designs using, e.g., a cross bar 146 extending between the first and second sides of the sofa frame and side bars 147 along the inner part of sides 122, 124 of the sofa frame, which serve for the attachment of conversion mechanism 130 to the frame.

The mechanism 130 is secured in the bottom of the box-like structure. It may consist of a stationary support structure 131 and telescoping sliding support structures 132, 134. Each of these structures may have a planar mesh surface with reinforcing metal plates or channels 133 at their edges and perhaps a center channel 139 down their middle. As an alternative, the mesh may be replaced with slats or springs of metal or other material. Instead of a planar surface, the stationary support 131 may have a box-like structure open at its front.

Figure 2:
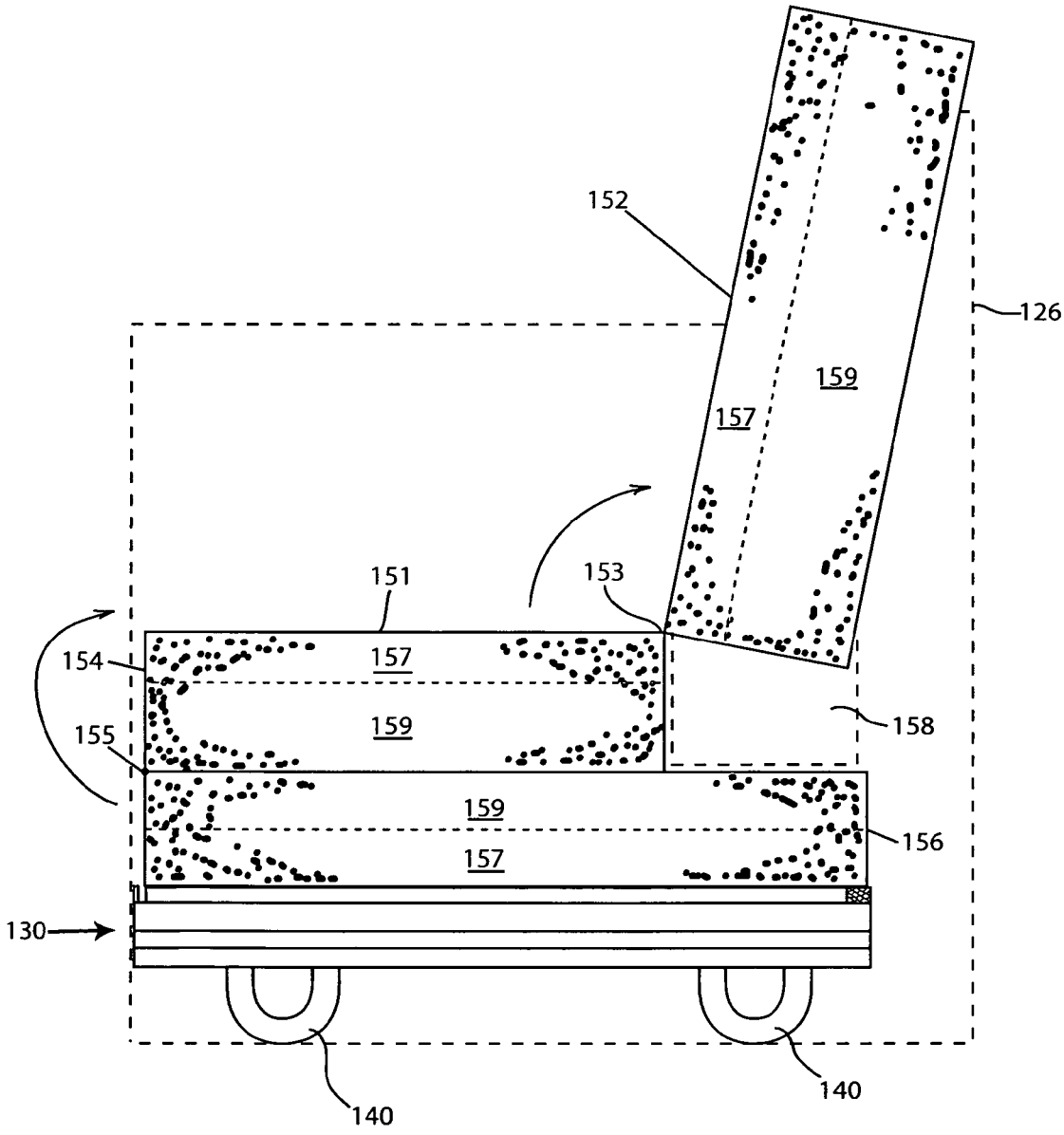
FIG. 2 is a side view of the embodiment of FIG. 1 when the sofabed mechanism and mattress of the present invention in the closed position with relation to a sofa frame.
Figure 4:
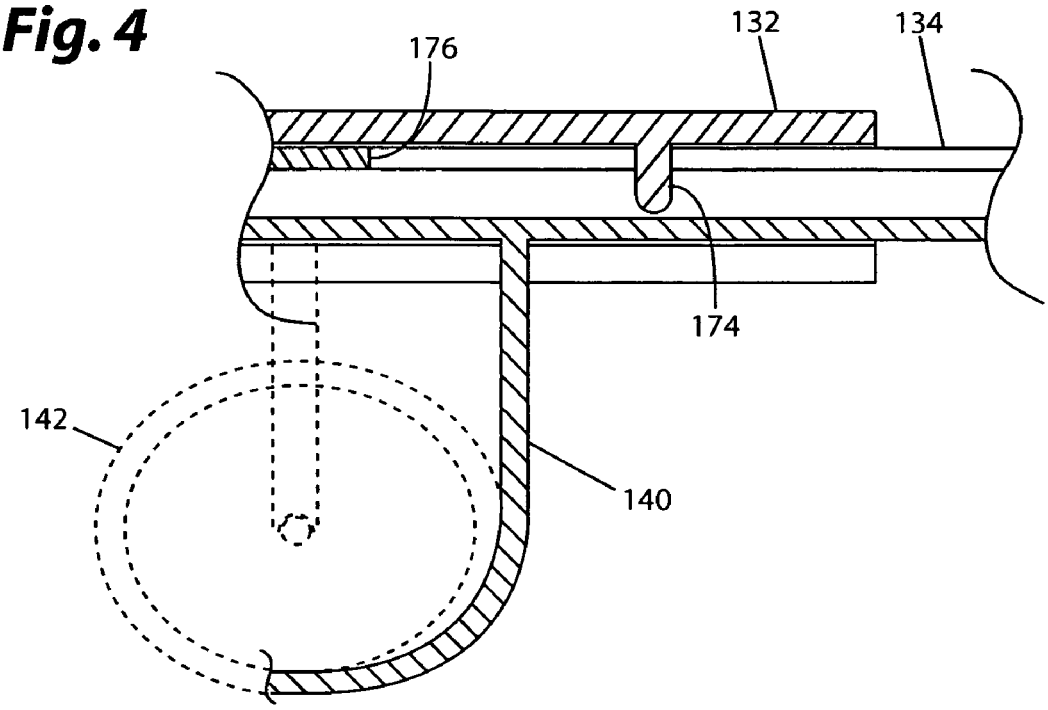
FIG. 4 is a partially cutaway cross-sectional view of the legs of the sofabed along section lines 4-4 of FIG. 1.

The mechanism 130 forms the base of the seat of a sofa when the sofabed is in the closed position (FIG. 2). The stationary support part 131 also holds the two telescoping sliding support structures 132, 134. When the two sliding support structures are telescoped out of the stationary support, those support structures provide the base for a bed. While the stationary structure 131 does not move during conversion from a sofa to a bed and vise versa, the two support structures 132, 134 do move over the floor. The curved legs 140 extend from the bottom of each of the sliding support structures 132, 134. The curve of the legs 140, as shown in FIG. 4, allows them to pass over carpet without snagging and the smooth surface of the legs allows them to pass over hardwood floors without doing damage. In one embodiment, the curved legs may be embodied as wheels 142 (shown in dotted line in FIG. 4).

Figure 6:
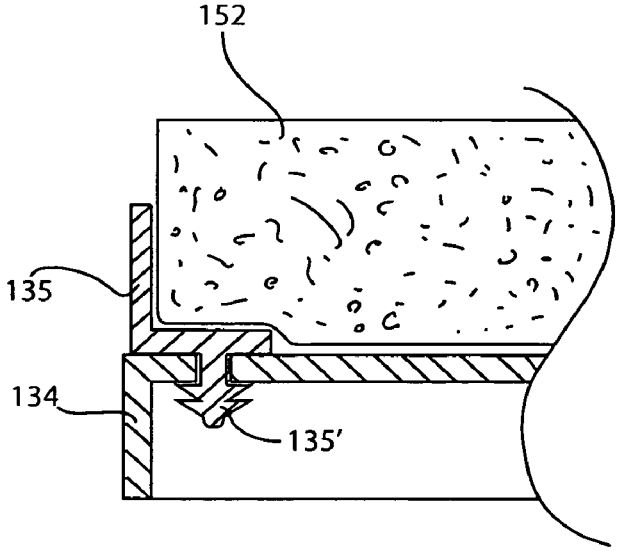
FIG. 6 is a partially cutaway cross section of an outer anchor plate attached to the end of the slide support mechanism and holding the mattress in place.

As shown in FIG. 1 a three-part mattress 150 is used with the design to form the bed located on the mechanism 130 after the two sliding support structures 132, 134 have been telescoped into their extended position. The arrangement of the mattress parts when in the sofa configuration is shown in dotted line in FIG. 1. As shown in FIG. 6 an anchor plate 135 may be located at the distal end of the outermost telescoping support structure 134 to assist in holding the mattress 150 in place. Also, there may be a vertical lip around the outer edge of the frame to further secure the mattress in place. As shown in FIG. 6, plate 135 may be connected to structure 134 by fasteners 135'.

The outermost part 152 of the mattress and the center part 154 are connected together along a hinge 153 at their bottom edges (FIG. 1). The center part 154 and the innermost part 156 are connected together along a hinge 155 at their contiguous top edges. The innermost part 156 of the mattress does not move during a conversation and remains in the same position. As a result, it can be fastened to the stationary structure 131 of mechanism 130.

The mattress is made of either foam, innerspring, or other bedding material, but must consist of two horizontal densities 157, 159. One side for sitting 157, the other side 159 for sleeping, because when the bed is closed the mattress becomes the sofa seat and back cushion. The width of the mattress will be standard size, full, queen, etc. The depth of the mattress varies with each section to compensated for the height changes of the telescoping support structures, thereby making the top (sleeping) level of the mattress even. In particular, section 152 is thicker than section 154 by the difference in height of the top parts of the sliding support structures 134, 132. Similarly the mattress section 154 is thicker than section 156 by the difference in the heights of sliding support structure 132 and stationary structure 131.

A mattress cover (not shown) can be used to hold the three pieces of the mattress together. This cover must wrap each part of the mattress separately on the top or sleeping side, but cover them as one on the sitting side, holding it firmly together as one unit.

As can be seen by comparing the mattress in FIG. 1 with that in FIG. 2, when converted from a bed to a sofa, the center part 154 of the mattress is pivoted about its hinge 155 (arrow A) so that it lies on top of the innermost part 156 so that its bottom 151 in the bed configuration becomes the top of the seat in the sofa configuration. The outermost part 152 of the mattress is than pivoted around its hinge 153 (arrow B) and comes to rest against a slanted back 126 of the box-like sofa frame to form a comfortable backrest for the sofa. As shown in FIG. 2 a piece of cushion material 158 may be fixed on top of the innermost mattress part 156 where it abuts the back of the box-like sofa frame. This piece 158 can support the outermost part 152 of the mattress when it acts as a backrest and as a pillow when the sofabed is in the bed configuration. The two telescoping support structures 132, 134 are then slid back into the frame to complete the transformation from a bed to a sofa.

Figure 5:
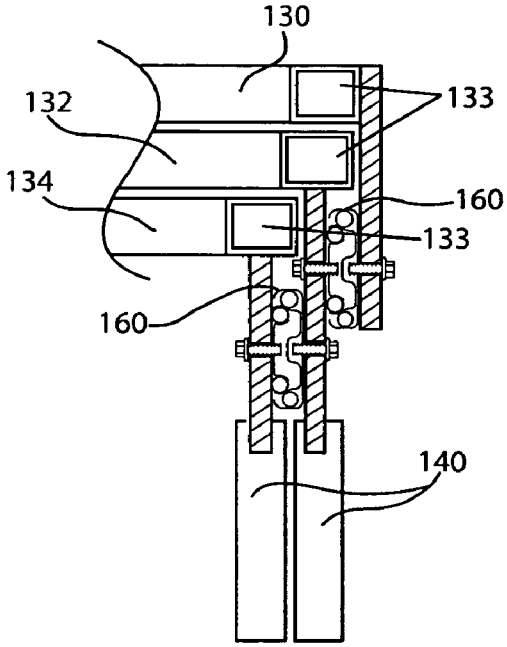
FIG. 5 is a cross-sectional view of the slide support mechanism along section lines 5-5 of FIG. 1.

The stationary and telescoping structures have legs 140 extend downwardly from the bands 133 or bar 137 of the support structures. As noted in FIGS. 3 and 5, the legs of the outermost sliding support structure 134 are offset from the legs of the innermost sliding support structure 132 so they do not collide when the structures are telescoped together. These structures may be provided with ball bearings 160 to ease the telescoping action. Further, the legs 140 are sturdy, but smooth, and have a curved shape as shown in FIG. 2 and FIG. 4, so that they can travel over carpet and hardwood floors without incident. As noted in dotted line in FIG. 4, the legs may be formed as wheels 142.

Figure 3:
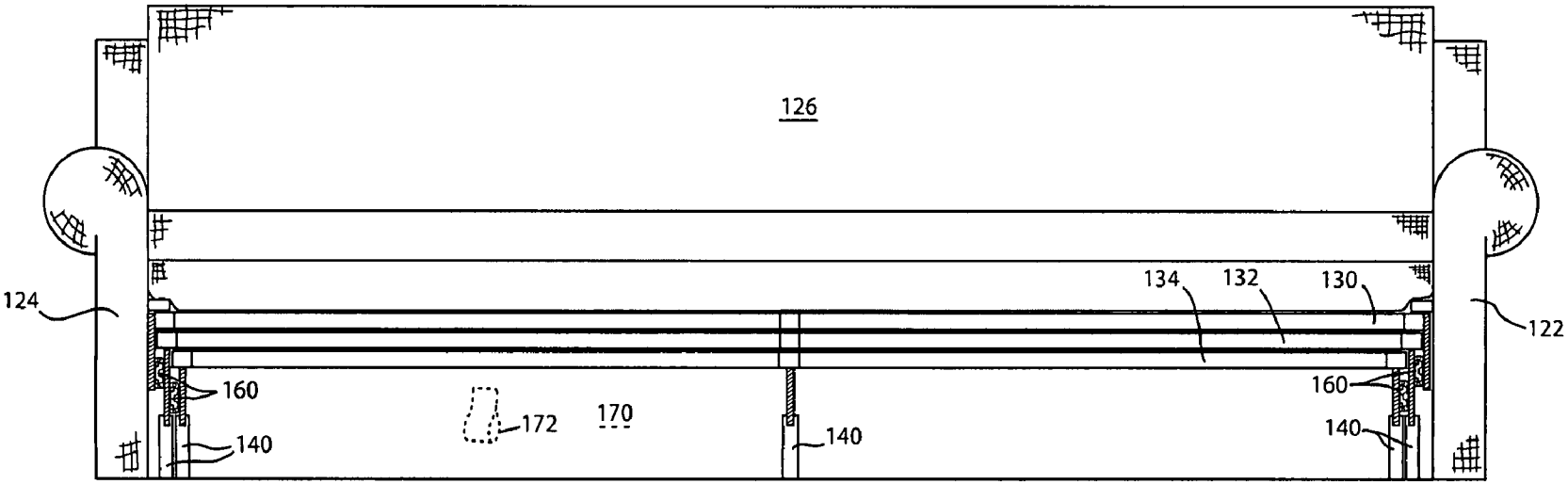
FIG. 3 is a front view of the embodiment of FIG. 2 showing the sliding support structure.

FIG. 1 and FIG. 3 show the front of the frame 130 as being open. However, a front cover plate 170 (shown in dotted line in FIG. 3) may be attached the front of support structure 134 to conceal the frame and support structures. This cover may also include a handle 172 which may be used to extend the sliding support structures during a conversion from a sofa to a bed.

FIG. 4 shows the legs 140 at the outer edge of the inner support structure 132 with support structure 134 extending there from. A stop 174 on structure 132 engages a surface 176 on structure 134 when it is fully extended so as to prevent further movement. As an alternative, locking detents (not shown) may be located along the side rails of the support structures so that when fully extended the detents engage so that the supports do not move. If the detents are spring loaded, pressure on the structures towards the backrest 126 will cause the detents to disengage, allowing the support structures to telescope into the frame 130.

When the sofabed 120 is in the closed position in which it functions as a sofa, certain surfaces are exposed to view. These exposed surfaces can be covered with fabric, leather or plastic to present a desired decorative motif. In fact, the sofa frame can have any conventional design and the mechanism and mattress are constructed to work such designs.

While the invention has been particularly shown and described with reference to an exemplary embodiment thereof, it will be understood by those skilled in the art that various changes in form and details may be made therein without departing from the spirit and scope of the invention.

I claim:

1. A sofabed that is convertible between a sofa when closed and a bed when open, the sofabed adapted to stand on a surface such as a floor, the sofabed comprising:

a sofa frame with a first side, a second side and a back connecting the first side to the second side substantially at right angles so as to form a box-shaped structure;

a stationary support structure located between and connecting the first side to the second side of the sofa frame and positioned in front of the sofa frame back;

an outermost sliding support structure and an innermost sliding support structure connected to the stationary support structure, the outermost sliding support structure telescopes into the innermost sliding support structure and the innermost sliding support structure telescopes into the stationary support structure when in a closed position, and the outermost sliding supporting structure extends out of the innermost sliding supporting structure and the innermost supporting structure extends out of the stationary support structure when in an open position;

legs extend from the sliding support structures to the floor to support those structures, said legs being curved where they contact the floor; and a three-part mattress formed of a fixed portion attached to the stationary support structure, a central portion and a sofaback portion, the fixed portion adjoining the stationary support structure and not moving with respect thereto in going between the open and closed positions, the central portion connected to the fixed portion by a first hinge at the top of their adjacent edges, the sofaback portion connected to the central portion by a second hinge at the bottom of their adjacent edges, the sofaback portion being placed in a generally vertically inclined position in contact with the frame when the sofabed is in the closed sofa position.

2. A sofabed as claimed in claim 1 wherein legs of the sliding supporting structures are fastened to channels at the edges of the sliding support structures.

3. A sofabed as claimed in claim 1 wherein the legs of the outermost sliding support structure are offset from the legs of the innermost sliding support structure so they do not interfere with the telescoping of the outermost sliding support structure into the innermost sliding support structure.

4. A sofabed as claim in claim 3 wherein the legs have wheels.

5. A sofabed as claimed in claim 1 wherein the mattress has two densities, the lesser density is on the side of the mattress portions that form a top surface when arranged as a bed and the greater density is at least on the side of the central portion that forms the seat of the sofa.

6. A mechanism and mattress for making a sofa that is convertible between a sofa when closed and a bed when open, the sofa being adapted to stand on a surface such as a floor and having a sofa frame that includes a first side, a second side and a back connecting the first side to the second side substantially at right angles so as to form a box-shaped structure, said mechanism and mattress comprising:

a stationary support structure located between and connecting the first side to the second side of the sofa frame and positioned in front of the back of the sofa frame;

an outermost sliding support structure and an innermost sliding support structure connected to the frame, the outermost sliding support structure telescopes into the innermost sliding support structure and the innermost sliding support structure telescopes into the frame when in a closed position, and the outermost sliding supporting structure extends out of the innermost sliding supporting structure and the innermost supporting structure extends out of the frame when in an open position;

legs extend from the support structures to the floor to support that structure, said legs being curved where they contact the floor; and a three-part mattress formed of a fixed portion attached to the frame, a central portion and a sofaback portion, the fixed portion adjoining the frame and not moving with respect thereto in going between the open and closed positions, the central portion connected to the fixed portion by a first hinge at the top of their adjacent edges, the sofaback portion connected to the central portion by a second hinge at the bottom of their adjacent edges, the sofaback portion being placed in a generally vertically inclined position in contact with the frame when the sofabed is in the closed sofa position.

7. A mechanism and mattress as claimed in claim 6 wherein legs of the sliding supporting structures are fastened to channels at the edges of the sliding support structures.

8. A mechanism and mattress as claimed in claim 6 wherein the legs of the outermost sliding support structure are offset from the legs of the innermost sliding support structure so they do not interfere with the telescoping of the outermost sliding support structure into the innermost sliding support structure.

9. A mechanism and mattress as claim in claim 8 wherein the legs have wheels.

10. A mechanism and mattress as claimed in claim 6 wherein the mattress has two densities, the lesser density is on the side of the mattress portions that form a top surface when arranged as a bed and the greater density is at least on the side of the central portion that forms the seat of the sofa.

* * * * *